US005647416A

United States Patent [19]

Desrosiers et al.

[11] Patent Number: 5,647,416

[45] Date of Patent: Jul. 15, 1997

[54] BOTTLED WATER DISPENSER SYSTEM

[75] Inventors: André Desrosiers; Dirk Stewart Zijlstra, both of Montreal, Canada

[73] Assignee: Les Produits Addico Inc., Pointe-Claire, Canada

[21] Appl. No.: 619,453

[22] Filed: Mar. 15, 1996

[51] Int. Cl.[6] ..... B65B 1/04

[52] U.S. Cl. ..... 141/351; 141/18; 141/364; 222/146.6; 222/146.1

[58] Field of Search ..... 141/346–364, 141/285, 286, 18, 20, 21, 288–301, 308; 222/146.6, 146.1; 128/200.13, 200.19, 200.21

[56] References Cited

U.S. PATENT DOCUMENTS

| | | | |
|---|---|---|---|
| 3,892,235 | 7/1975 | Van Amerongen et al. | 141/308 |
| 4,846,236 | 7/1989 | Deruntz | 141/329 |
| 4,902,320 | 2/1990 | Schroer et al. | 55/385.1 |
| 5,246,141 | 9/1993 | Burrows | 222/146.1 |
| 5,289,854 | 3/1994 | Baker et al. | 141/18 |
| 5,307,958 | 5/1994 | Burrows | 222/146.1 |
| 5,413,152 | 5/1995 | Burrows | 141/364 |
| 5,431,205 | 7/1995 | Gebhard | 141/351 |
| 5,526,961 | 6/1996 | Burrows | 141/351 |

*Primary Examiner*—Henry J. Recla
*Assistant Examiner*—Steven O. Douglas

[57] ABSTRACT

A liquid container support housing is provided with a removable container support dispenser which is seated at an open top end of a removable liquid holding reservoir provided in the support housing. The container support dispenser has a central upwardly projecting feed probe on a bottom wall thereof and which is dimensioned to enter a cap secured over an opening of a neck end of a liquid container supported in an inverted position on the container support dispenser. The feed probe has a plug engaging end adapted to disconnect a sealing plug formed integral with the cap, when the probe enters a central sealing sleeve of the cap in close sealing fit therein, and for engaging the plug spaced from an internal end of the sleeve when disconnected therefrom. The feed probe has a liquid conduit therein to channel liquid from the liquid container into the liquid dispensing reservoir of the support housing. The feed probe further has an air conduit having a small opening in a top part of the probe below the plug engaging end and dimensioned to provide pressure control to dispense liquid from the container into the holding reservoir by admitting the necessary amount of air within the reservoir.

10 Claims, 6 Drawing Sheets

BOTTLED WATER DISPENSER SYSTEM

TECHNICAL FIELD

The present invention relates to a bottled water dispenser system and particularly to a container support housing having a removable container support dispenser with a central feed probe having a water discharge conduit, and a separate pressure control air conduit leading into the water reservoir whereby to provide a controlled discharge of water from the container. The support dispenser is sealingly seated on an open-ended removable reservoir in the top portion of the housing.

BACKGROUND ART

Bottled water dispenser systems are known whereby to dispense water from an inverted water bottle having a hygienic cap and positioned in an inverted manner over a top portion of a dispensing housing. These systems are usually provided with a dispenser insert having a probe which enters a sealing sleeve of a hygienic cap about the bottle neck opening. The probe disconnects a sealing plug within the cap whereby water can be discharged from the bottle through a conduit provided in the probe. As the water is discharged through the conduit, air bubbles move up into the water container through the conduit to regulate the pressure. A typical example of such system is described in U.S. Pat. No. 5,289,854 and many of its associated patents and a further example of the dispenser insert is described in U.S. Pat. No. 4,846,236. Such prior art systems can be said to be imperfect as many of these do not provide a sufficient discharge rate of the water as contained within the containers when a large supply of water is demanded from the internal reservoir of the housing. Also, some of these systems are complex in construction and provided with sealing membranes at the top end of the internal reservoir whereby to seal the reservoir from dust and other debris. Another source of contamination of the water may be caused by the manipulation of the container when placed or removed from the dispensing housing.

SUMMARY OF INVENTION

It is a feature of the present invention to provide a bottled water dispenser system which is an improvement of prior art systems and which provides an improved dispensing flow rate of the water from the bottle into the housing reservoir and which is capable of admitting sufficient air through a separate air supply conduit as water is being dispensed through large orifices provided in the probe.

Another feature of the present invention is to provide a bottled water dispenser system which is constructed of few parts and wherein the water reservoir of the housing is separated in two portions to provide water at different temperatures.

Another feature of the present invention is to provide a bottled water dispenser system which is highly hygienic and which is easy to clean and replace.

According to the above features, from a broad aspect, the present invention provides a liquid container support housing having a removable container support dispenser seated at an open top end of a removable liquid holding reservoir provided in the support housing. The container support dispenser has a central upwardly projecting feed probe on a bottom wall thereof. The probe is dimensioned to enter a cap secured over an opening of a neck end of a liquid container supported in an inverted position on the container support dispenser. The feed probe has a plug engaging end adapted to disconnect a sealing plug connected at an internal end of the cap, when the probe enters a central sealing sleeve of the cap in close sealing fit therein. The plug engaging end also engages the plug and disposes it spaced from an internal end of the sleeve when disconnected therefrom. The feed probe has liquid conduit means therein to channel liquid from the liquid container into the liquid dispensing reservoir of the support housing. The feed probe is further provided with an air conduit means having a small opening in a top part of the probe below the plug engaging end and dimensioned to admit air into the liquid container from the open top end of the liquid holding reservoir when liquid is dispensed through the liquid conduit means and to substantially prevent liquid flow therethrough from the liquid container to the reservoir. The open top end of the liquid holding reservoir is in contact with outside air to admit air into the air conduit means.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
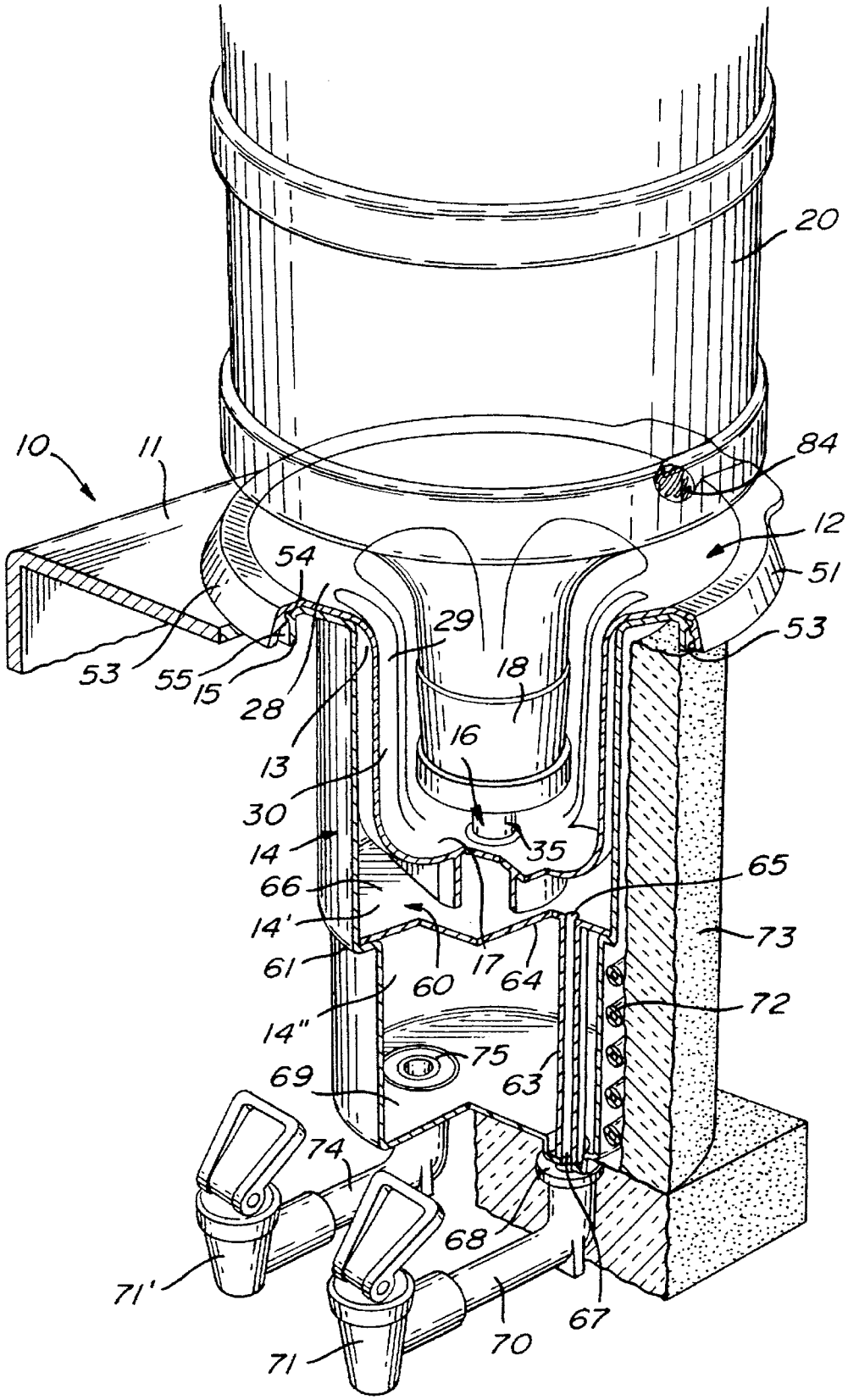
FIG. 1A is a fragmented perspective view, partly in section, illustrating the bottled water dispenser system of the present invention and wherein a water container is supported in an inverted manner over a support dispenser seated at a top end of the housing over a liquid holding reservoir.
Figure 1B:
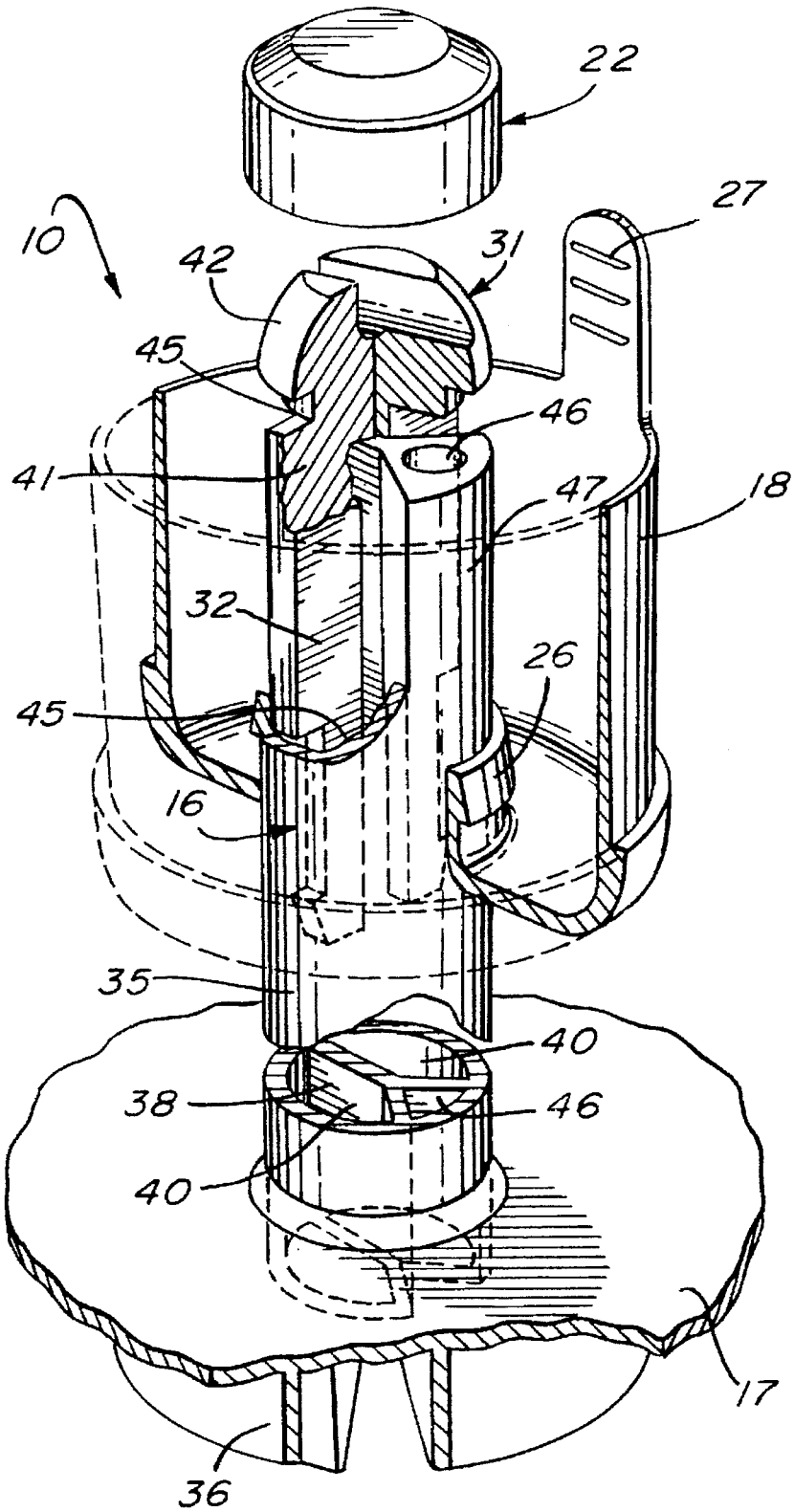
FIG. 1B is a fragmented perspective view of the feed probe when inserted in a water bottle cap.

Referring now to the drawings, and more particularly to FIGS. 1A and 1B, there is shown generally at 10 the bottled water dispensing system of the present invention. The system comprises a liquid container support housing 11 having a removable container support dispenser 12 seated about an open top end 13 of a removable liquid holding reservoir 14. More specifically the container support dispenser 12 is in seating engagement about a circumferential support ring 15 disposed about the open top end 13 of the reservoir 14.

As herein illustrated more schematically, the container support dispenser 12 has a central upwardly projecting feed probe 16 extending upwardly and central of a bottom wall 17 thereof. The probe 16 is dimensioned to enter a cap 18 secured over an opening 19 of a water container 20, as more clearly illustrated in FIG. 2.

Figure 2:
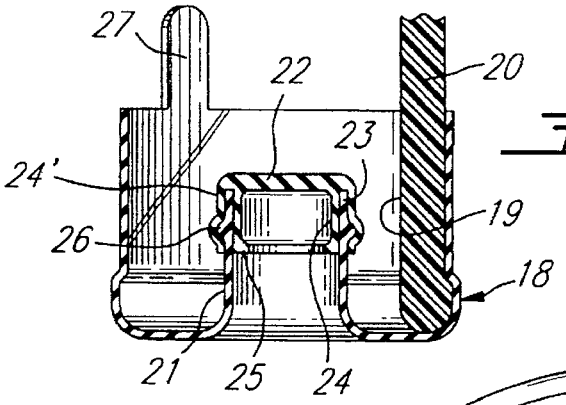
FIG. 2 is a section view illustrating the construction of the hygienic cap secured about an opening of a neck end of a liquid container.

As shown in FIG. 2, the hygienic cap 18 has an internally projecting central sealing sleeve 21 which extends into the opening 19 of the liquid container or water bottle 20 and has a sealing plug 22 removably and sealingly secured to an internal end 23 of the sleeve 21. The sealing plug 22 has an inner circumferential wall 24 provided with a circumferential rib 25 to engage with the head 42 of the probe 16 as will be described later. The sealing plug 22 has an outer sleeve 24' sealingly secured about the internal end 23 of the sealing sleeve 21 and extends over a circumferential sealing rib 26. A tear tab 27 is provided to disconnect the cap from the open end of the liquid container 20, as is well known in the art.

Referring again to FIGS. 1A and 1B, the liquid container 20 is shown supported in an inverted manner over the container support dispenser 12 and rests on a circumferential support side wall 28 as well as large ribs 29 which project inside the bowl-shaped cavity 30. As the hygienic cap 18 is aligned with the probe 16 and the bottle is lowered over the probe, the probe enters the central sealing sleeve 21 of the cap and is in close sealing fit therein. The feed probe has a plug engaging end 31 which enters into the inner circumferential wall 24 of the sealing plug 22 and engages the plug and disconnects it from the internal end 23 of the sealing sleeve 21 and pushes it inwardly into the neck of the bottle. The sealing plug 22 is thus disconnected from the central sealing sleeve and exposes an upper intake end 32 of a conduit provided in the probe whereby water may be discharged from the bottle 20 and into the liquid holding reservoir 14.

The head 42 of the probe is provided with a circumferential undercut 48 to engage with the circumferential rib 25 of the sealing plug 22, as shown in FIG. 2, whereby to retain the plug 22 about the head when the plug is disconnected from the sealing sleeve 21. When the container 20 is removed from the container support dispenser 12, the probe 16 is retracted from the sealing sleeve 21 and draws the sealing plug back into engagement with the internal end 23 of the sealing sleeve to reconnect it whereby to maintain the inner area of the container sanitary. This operation of the probe and its disconnection and reconnection of the sealing plug is also known in the art.

Figure 4:
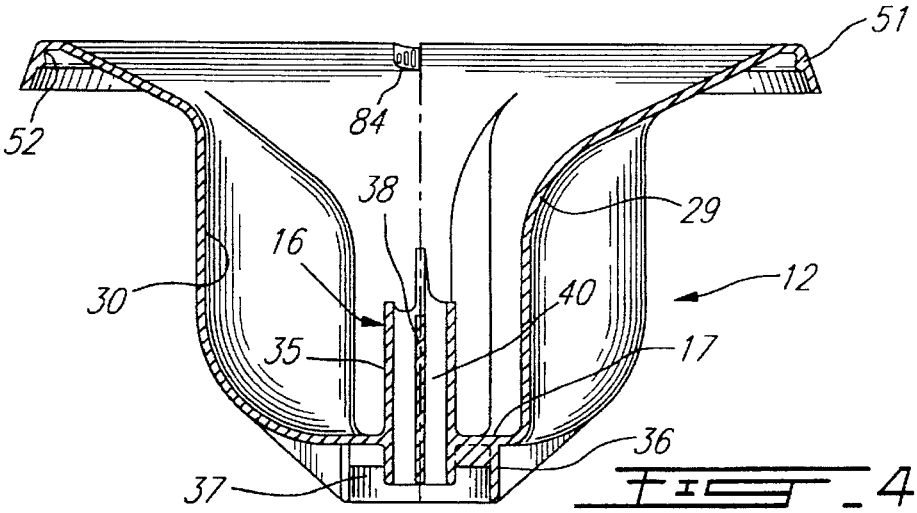
FIG. 4 is a section view of the container support dispenser.
Figure 5:
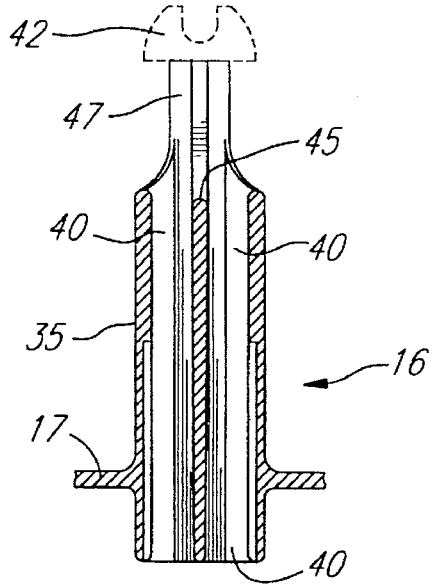
FIG. 5 is a partly fragmented side view showing the construction of the feed probe cylindrical body.
Figure 6:
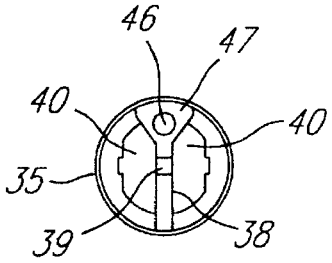
FIG. 6 is a top view of FIG. 5.
Figure 7:
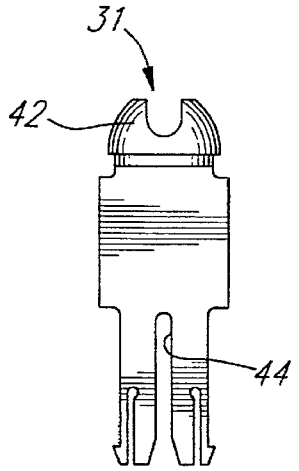
FIG. 7 is a side view showing the construction of the plug engaging end of the feed probe connected to the cylindrical body of FIG. 5.
Figure 8:
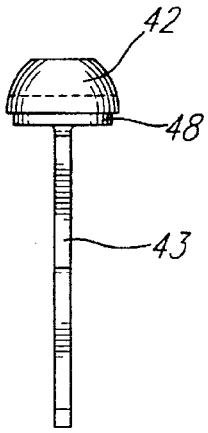
FIG. 8 is a side view of FIG. 7.

Referring now to FIGS. 4 to 8, there will be described the construction of the feed probe 16. As shown in FIGS. 4, 5 and 6, the feed probe 16 has a hollow cylindrical upstanding body 35 formed integral with the bottom wall 17 of the container support dispenser 12 and extends thereunder into a support ring 36 having side openings 37 to permit water to pass from inside the bottle into the liquid holding reservoir 14, as shown in FIGS. 1A and 1B. Because the feed probe is integrally formed with the bottom wall, it is obviously sealingly connected thereto. A dividing wall 38 is disposed diametrically across the cylinder body 35 and is provided with a slot 39 in the top end portion thereof. Opposed conduit sections 40 are defined between the separating wall 38. The plug engaging end 31 of the feed probe 16 is provided by a support member 41 which has the dome-shaped head 42 at a top end. The support member 41 has a flat rectangular wall 43 provided with a slot 44 and a bottom part thereof and fits over the slot 39 of a division wall whereby to position the head spaced from the top opening 45 of the conduit sections 40. The wall 43 forms a further transverse division wall. A large upper intake opening 32 is formed between the head 42 and the top opening 45 whereby to admit water within the divided conduit sections 40.

Figure 12:
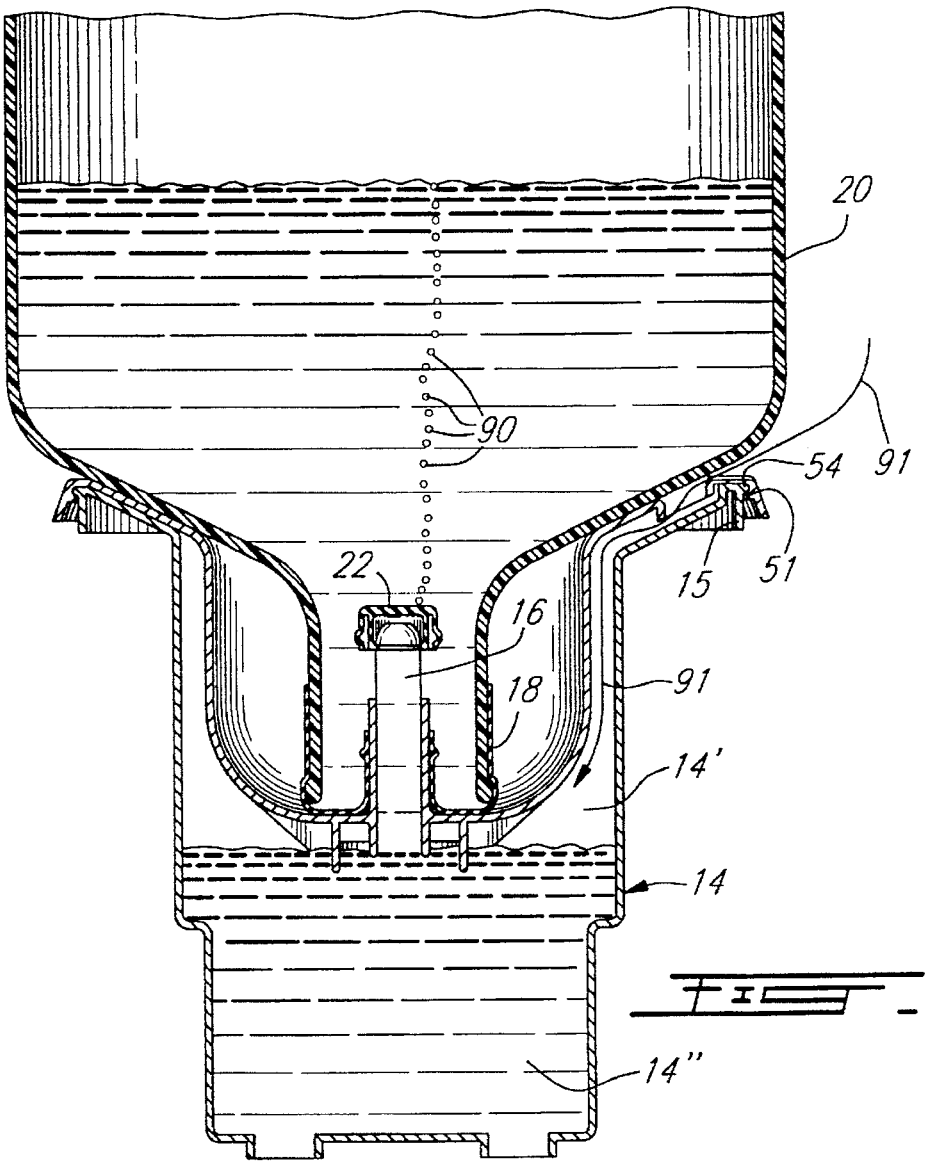
FIGS. 12 and 13 are schematic section views showing the operation of the dispensing probe.
Figure 13:
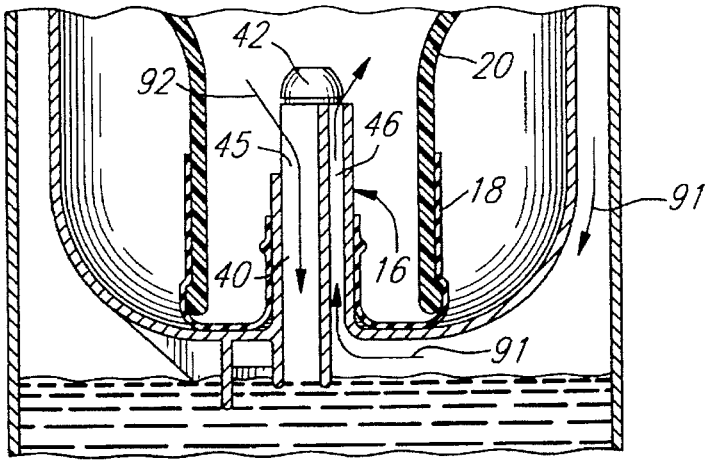

As shown in FIGS. 6, 12 and 13 an air conduit 46 extends within a solid section 47 of the cylindrical upstanding body 35 and is disposed at an end of division wall 38. The air conduit 46 is ⅛" in diameter and this size was calculated to admit sufficient amount of air within the dispensing container 20 to provide adequate liquid discharge through the conduit sections 40 of the cylindrical body. It compensates for the differential pressure when water is removed from the liquid holding reservoir 14. The top end of the air conduit 46 is spaced closely below the dome-shaped head 42.

Normally, by gravity the water will flow from the bottle 20 down through the feed tube 16 into the reservoir 14. This process will continue until the partial vacuum created in the bottle will create enough negative pressure to be in balance with the resistance that the air has to overcome that would have to flow from the outside air at normal atmospheric pressure, through the surface of the water in the reservoir up through the feed tube into the bottle. The resistance that the air has to overcome is the sum or combination of three forces: the first one is breaking the surface tension of the water in the low reservoir, the second is the upward pressure equivalent to the weight of the water that is displaced by the air that is on its way down toward the feed tube, and the last one is the force needed to move the air along the horizontal surface toward the feed tube. Once past the inside of the horizontal surface the air bubble will move upward pushed by the force equal to the weight of the displaced water in the bottle. In the feed tube 14 the only resistance that the air encounters is the water flow running in the opposite direction. Once in the bottle it will fill up the partial vacuum, allowing the water to flow again by gravity. The only two variables in the process are the level of the water in the lower reservoir 14" and the level of vacuum in the bottle 20. By raising or lowering the level of water in the lower reservoir, the resistance the air bubble has to overcome increases or decreases. The higher the level of vacuum the more force is available to overcome the combined resistance described before. A number of factors influence the process positively. First the shape of the surface of the water, the bigger the surface of the reservoir holding the water in the lower reservoir the lower the pressure on that surface helping the air to find it's way between the water and the wall of the reservoir. Secondly, the horizontal distance between the closest vertical wall of the top reservoir and the vertical wall leading toward the feed tube. Thirdly, the size of the bubbles 90, the smaller they are, the lower the resistance created by the displaced water, and lastly the division of the feed tube in a channel 46 for the air and conduits 40 for the water, which reduces the interference of the downward running water with the up going air. By starting and finishing the air channel 46 higher than the water channels 40 in the feed tube, the interference is reduced. Air flow is depicted by arrow 91 in both FIGS. 12 and 13 and water flow from the bottle 20 is depicted by arrow 92.

Figure 3:
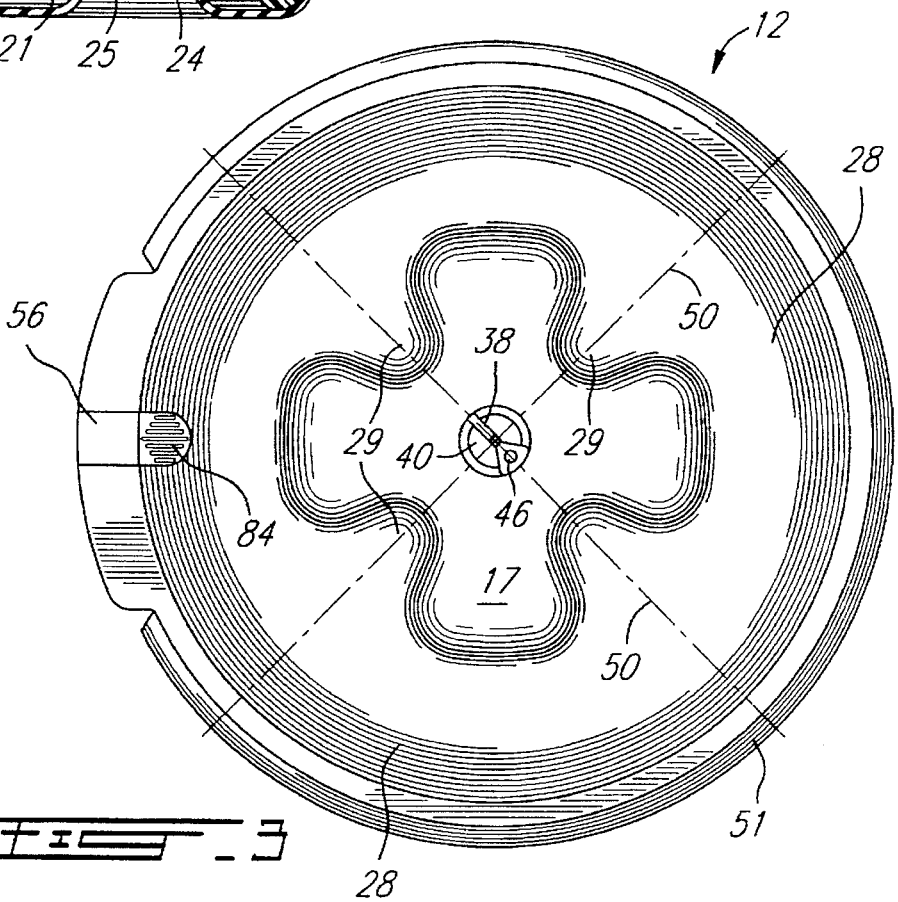
FIG. 3 is a top view of the container support dispenser.

Referring now to FIG. 3, there is shown a top view of the container support dispenser 12. As can be seen from FIGS. 3 and 4, the dispenser has a bowl-shaped cavity 30 disposed in a central part thereof and which extends from the bottom wall 17. There are four large support ribs 29 extending on transverse diametrical axes 50 and formed integrally on the side wall of the cavity and extend to the container support side wall 28. These ribs reinforce the container support dispenser 12 and particularly in the area where the heavy container 20 rests on the support dispenser. The container support wall 28 merges into a circumferential support flange 51 for support engagement on the disc support ring 15, as shown in FIG. 1A. Any water spilled during positioning of the bottle or any debris will be captive within the bowl which can be easily cleaned.

Figure 9:
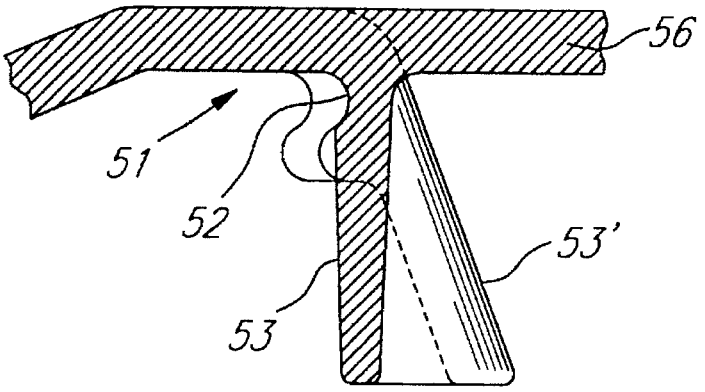
FIG. 9 is an enlarged fragmented view showing the manner in which the container support dispenser is sealingly engaged and disengaged from a circumferential rib formed on top of the liquid container support housing about the open ended liquid holding reservoir.

As shown in FIGS. 9 and 1A, a circumferential sealing channel 52 is formed integral with an inner side face 53 of the circumferential support flange 51 for sealing engagement with a circumferential rib 54, as shown in FIG. 1A, and formed about an outer side wall 55 of the support ring 15. The flange also has a handle portion 56 formed integrally therewith to permit the side wall 53 to flex out, such as shown as 53' in FIG. 9, to disconnect the channel 52 from the rib 54 when it is necessary to remove the container support dispenser 12 from sealing engagement with the top part of the liquid holding reservoir 14.

Figure 11:
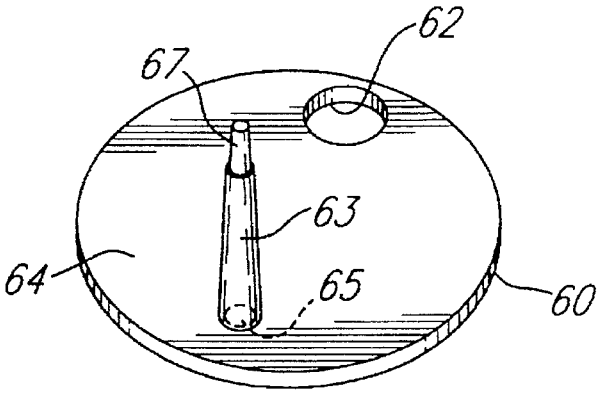
FIG. 11 is a perspective view showing the construction of the separating wall of the liquid holding reservoir.

Referring to FIG. 1A, it can be seen that the liquid holding reservoir 14 has a top reservoir portion 14' and a bottom reservoir portion 14". These portions are delineated by a removable separating wall 60 as better illustrated in FIG. 11 which is displaceably supported transversely across reservoir portions by a circumferential support ridge 61 formed integral with the reservoir. The separating wall 60, as shown in FIG. 11, has a large opening 62 therein whereby water can pass freely between the reservoir top portion 14' where water is discharged from the container 20 down to the bottom reservoir portion 14". A straight hollow rigid pipe 63 extends from an underface 64 of the separating wall 60 and has an inlet opening 65 formed on a top face 66 of the separating wall. The rigid pipe has a lower connecting end 67 which is dimensioned for close fit in a coupling bushing 68 which is secured to the bottom wall 69 of the reservoir 14 and interconnects, through a conduit 70, with a dispensing valve 71 connected to the housing 11 whereby to dispense liquid from the top reservoir portion 14' when necessary. The water in that reservoir is at a higher temperature than that of the bottom reservoir for the reason that the bottom reservoir is surrounded by cooling coils 72 disposed thereabout and insulated by an insulating jacket 73. A conduit 74 also connects to a coupling bushing 75 secured to the bottom wall 69 of the holding reservoir to dispense water to a further dispensing valve 71 disposed side-by-side with the dispensing valve 71 whereby to dispense cooler water.

Figure 10A:
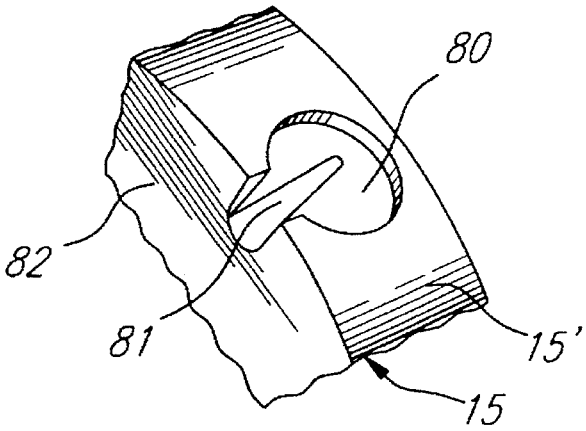
FIG. 10A is a fragmented perspective view showing the construction of the filter retaining cavity formed in the reinforcing ring to communicate the top end of the liquid holding reservoir with outside air.
Figure 10B:
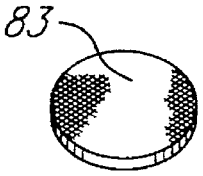
FIG. 10B is a perspective view of the filter engageable within the filter retaining cavity of FIG. 10A.

Although the container support dispenser 12 is sealingly engaged about the circumferential support ring 15 there is a need to admit outside air within the open top end 13 of the liquid holding reservoir 14. As shown in FIGS. 10A and 10B, this is accomplished by providing a filter retaining cavity 80 within the reinforcing ring 15 and more specifically in the top wall 15' of the ring. The cavity has a channel portion 81 which extends into the inner side wall 82 of the ring. A filter disc 83 fits within the cavity 80 and permits the filtering of air passing therethrough. As shown in FIG. 3, the container support dispenser 12 is also provided with an air opening 84 in a top part of the support wall 28 thereof and this opening is positioned in registry above the cavity 80 whereby air will enter into the open top end of the reservoir by passing through the opening 84, the filter disc 83 and the channel 81. Accordingly, there is provided a hygienic seal between the support ring 15 and the container support dispenser 12 while filtered air is freely admitted within the top part of the reservoir.

It is within the ambit of the present invention to cover any obvious modifications of the preferred embodiment described herein, provided such modifications fall within the scope of the appended claims.

We claim:

1. A liquid container support housing having a removable container support dispenser seated at an open top end of a removable liquid holding reservoir provided in said support housing, said container support dispenser having a central upwardly projecting feed probe on a bottom wall thereof, said probe being dimensioned to enter a cap secured over an opening of a neck end of a liquid container supported in an inverted position on said container support dispenser, said feed probe having a plug engaging end adapted to disconnect a sealing plug connected at an internal end of said cap, when said probe enters a central sealing sleeve of said cap in close sealing fit therein, and for engaging said plug spaced from said internal end of said sleeve when disconnected therefrom, said feed probe having liquid conduit means therein to channel liquid from said liquid container into said liquid dispensing reservoir of said support housing, said feed probe being further provided with air conduit means having a small opening in a top part of said probe below said plug engaging end and dimensioned to admit air into said liquid container from said open top end of said liquid holding reservoir when liquid is dispensed through said liquid conduit means and to substantially prevent liquid flow therethrough from said liquid container to said reservoir, said open top end of said liquid holding reservoir being in contact with outside air to admit air into said air conduit means, said feed probe being comprised by a hollow cylindrical upstanding body formed integral with said bottom wall of said container support dispenser, said liquid conduit means being constituted by at least one conduit disposed axially in said cylindrical body and having a lower open discharge end and an upper intake end, said upper intake end being spaced below said top part of said probe, therebeing division walls extending longitudinally in said hollow cylindrical upstanding body, at least two conduit sections defined between adjacent division walls, said hollow cylindrical upstanding body having an open said wall portion in said top part of said probe adjacent said at least two conduit sections and constituting said upper intake end.

2. A liquid container support housing as claimed in claim 1 wherein said open top end of said liquid holding reservoir is in contact with said outside air through an air passage means provided in a circumferential container support wall of said container support dispenser.

3. A liquid container support housing as claimed in claim 2 wherein said container support dispenser has a bowl-shaped cavity disposed in a central part thereof and extending from said bottom wall, a plurality of support ribs formed in a side wall of said cavity and extending to said container support wall, said container support wall having an outer circumferential support flange for support engagement on a support ring disposed about said open top end of said liquid holding reservoir.

4. A liquid container support housing as claimed in claim 3 wherein there is further provided a circumferential sealing channel formed integral with an inner side face of said circumferential support flange for sealing engagement with a circumferential rib formed about an outer side wall of said support ring.

5. A liquid container support housing as claimed in claim 3 wherein said air passage means is comprised by an opening provided in said container support wall of said container support dispenser.

6. A liquid container support housing as claimed in claim 5 wherein said opening is disposed in registry with a filter retaining cavity formed in said container support wall, said cavity having a passage communicating with said top end of said liquid holding reservoir.

7. A liquid container support housing as claimed in claim 1 wherein said liquid holding reservoir has a top and bottom portion, said portions being delineated by a removable separating wall displaceably supported transversely across said reservoir portions by support means, said separating wall having at least one opening therein to admit liquid from said top portion to said bottom portion, and a first conduit secured to an underface of said separating wall to communicate said reservoir top portion to a first dispensing valve, a second conduit interconnecting said reservoir bottom portion to a second dispensing valve, there being a cooling coil disposed about said reservoir bottom portion.

8. A liquid container support housing as claimed in claim 1 wherein said first conduit is a straight rigid pipe extending from said underface of said separating wall and having an inlet opening on a top face of said separating wall, said rigid pipe having a lower connecting end dimensioned for close fit in a coupling bushing to interconnect said pipe with said first and second dispensing valves through an intermediate conduit.

9. A liquid container support housing as claimed in claim 1 wherein said air conduit means is formed in a solid section of said cylindrical upstanding body.

10. A liquid container support housing as claimed in claim 1 wherein said plug engaging end is provided by a dome-shaped head secured at a top end of said probe, said head having a circumferential undercut to engage a circumferential rib provided about an inner wall of said sealing plug to retain said plug about head when disconnected from said sealing sleeve and to reconnect it to said sealing sleeve when said liquid container is removed from said container support dispenser, said small opening of said air conduit means being closely spaced from under said undercut of said dome-shaped head.

* * * * *